US006615784B2

(12) United States Patent
Faria et al.

(10) Patent No.: US 6,615,784 B2
(45) Date of Patent: Sep. 9, 2003

(54) VALVE TRAIN OF AN INTERNAL COMBUSTION ENGINE

(75) Inventors: Christof Faria, Erlangen (DE); Oliver Schnell, Veitsbronn (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/231,409

(22) Filed: Aug. 29, 2002

(65) Prior Publication Data

US 2003/0041820 A1 Mar. 6, 2003

(30) Foreign Application Priority Data

Aug. 30, 2001 (DE) ..... 101 42 329

(51) Int. Cl.[7] ..... F01L 1/14
(52) U.S. Cl. ..... 123/90.5; 123/90.48; 74/569
(58) Field of Search ..... 123/90.48, 90.5, 123/90.51, 90.15, 90.16, 90.17; 74/569, 567

(56) References Cited

U.S. PATENT DOCUMENTS 5,351,662 A * 10/1994 Dopson et al. ..... 123/90.16
6,164,255 A * 12/2000 Maas et al. ..... 123/90.16
6,257,185 B1 * 7/2001 Groh et al. ..... 123/90.16
6,257,189 B1 * 7/2001 Moretz et al. ..... 123/90.5
6,405,699 B1 * 6/2002 Church ..... 123/90.5
6,427,652 B2 * 8/2002 Faria et al. ..... 123/90.16
6,497,207 B2 * 12/2002 Spath et al. ..... 123/90.16

* cited by examiner

*Primary Examiner*—Thomas Denion
*Assistant Examiner*—Ching Chang
(74) *Attorney, Agent, or Firm*—Muserlian, Lucas and Mercanti

(57) ABSTRACT

In a valve train of an internal combustion engine, which valve train comprises an elongate anti-rotation bridge (6) comprising receptions spaced behind one another for receiving valve tappets configured as roller tappets (4), one of which tappets is arranged in each reception and is directed with a tappet roller (3) toward a cam (2) of a camshaft (1), the roller tappet (4) of the invention comprises on an outer peripheral surface, raised tappet contours (10, 11) that engage into retention grooves of the bridge (6) within the reception.

2 Claims, 5 Drawing Sheets

A - A

B - B

C - C

D - D

VALVE TRAIN OF AN INTERNAL COMBUSTION ENGINE

FIELD OF THE INVENTION

The invention concerns a valve train of an internal combustion engine, said valve train comprising an elongate anti-rotation bridge comprising receptions spaced behind one another for receiving valve tappets configured as roller tappets, one of which tappets is arranged in each reception and is directed with a tappet roller toward a cam of a camshaft to extend at a right angle to a longitudinal axis of the camshaft while being slidably retained in the reception, said tappet being secured against rotation through anti-rotation surfaces which are configured on an outer peripheral surface of the tappet and bear against corresponding inner surfaces of the bridge within the reception.

BACKGROUND OF THE INVENTION

It is known in internal combustion engines to secure a roller tappet against rotation by a plastic bridge in which the tappet is retained through surface guidance. The outer peripheral surface of the circular cylindrical tappet is configured with at least one flat surface portion that cooperates with a corresponding flat surface portion of a reception in the anti-rotation bridge. This bridge can be a plastic component. To simplify transportation and assembly of the components of the valve train, the tappets are pre-assembled on the anti-rotation bridge through a press fit at the surfaces that contact one another. However, the clamping of the tappets in the bridge that is required for mounting may also continue to exist later during engine operation so that the compensating function of a standard tappet and the switch-off movement of a switchable tappet may be impaired.

An anti-rotation bridge in which the clamping of the tappets required for mounting remains active even in subsequent engine operation when only the anti-rotation function is called for, is shown in the document U.S. Pat. No. 5,088,455 A.

In the document DE 197 12 610 A1, that shows an anti-rotation bridge of the pre-cited type for an internal combustion engine, it is explained that internal combustion engines generally comprise roller valve tappets that engage cam lobes of a camshaft. Since it is not desirable that the tappets rotate about their longitudinal axes because the rollers of the tappets must remain in the same plane as the cam lobes, the tappets are appropriately oriented in the cylinder block of the internal combustion engine with the help of suitable retaining devices, and their rotation is prevented. One example of such a retaining device is an anti-rotation bridge in whose receptions the tappets bear with their flat surface portions against corresponding flat portions of the bridge.

OBJECTS OF THE INVENTION

It is an object of the invention to create a valve train comprising an anti-rotation bridge and roller tappets adapted to be mounted therein that operates in a defined and reliable manner.

This and other objects and advantages of the invention will become more obvious from the following detailed description.

SUMMARY OF THE INVENTION

According to a first proposition, the invention achieves the above objects by the fact that the roller tappet comprises on its outer peripheral surface, raised tappet contours that engage into retention grooves of the bridge within the reception.

According to a second proposition, the invention achieves the above objects by the fact that a projecting solid bead is configured in each reception of the bridge and engages a tappet groove configured on the roller tappet.

In this way, when the bridge has been fixed in the engine block, the tappets can be pressed out of their assembly and retention position against the camshaft by installing the associated tappet push rods. The anti-rotation surfaces that are then still effective can be disposed without a pressing force or with only a small pressing force so that the compensating function and the switch-off function of the tappet are not impaired.

Examples of embodiment of the invention are illustrated in the appended drawings and will be described more closely in the following.

DETAILED DESCRIPTION OF THE DRAWING

Figure 1:
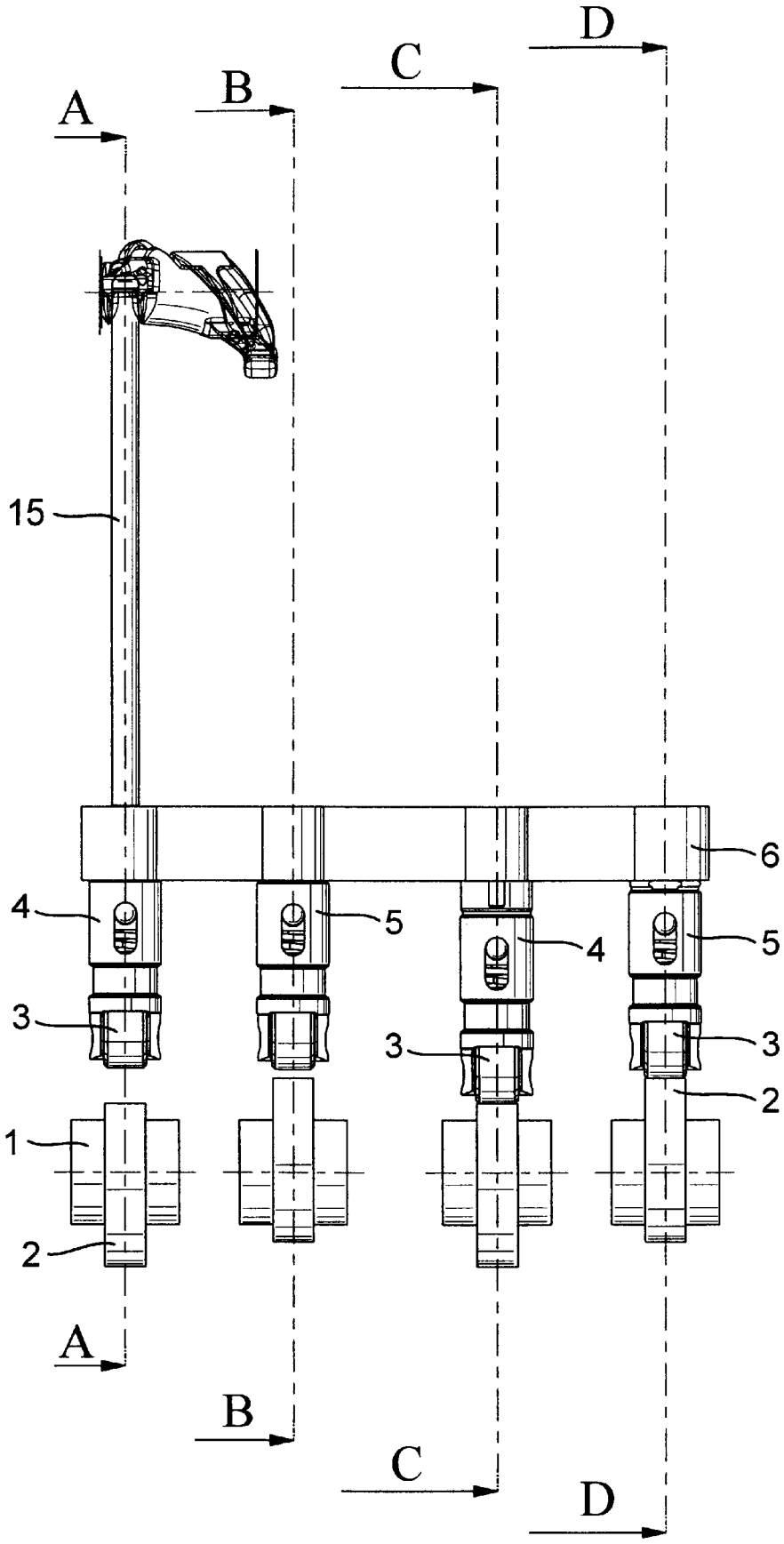
FIG. 1 is a side view of an anti-rotation bridge having four inserted roller tappets that are directed toward a camshaft.
Figure 2A:
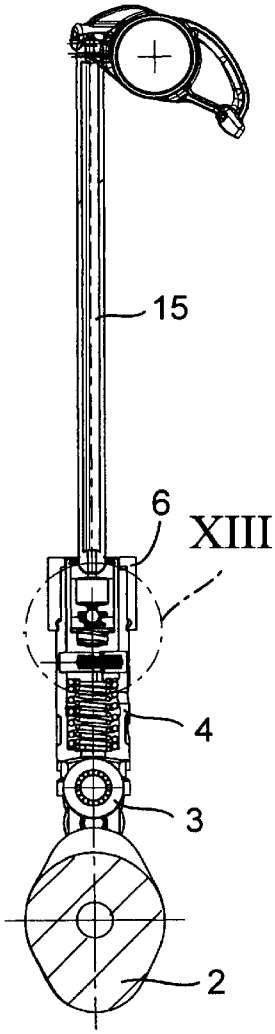
FIG. 2*a* is a sectional representation along line A—A of FIG. 1 showing a position of a roller tappet in the bridge before the final installation of an associated tappet push rod.
Figure 2B:
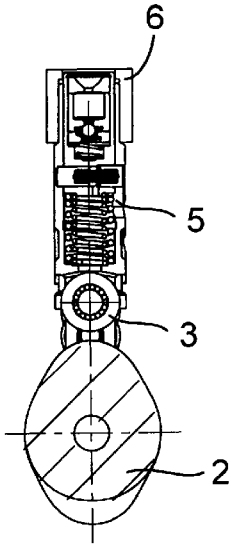
FIG. 2*b* is a sectional representation along line B—B of FIG. 1 showing a further position of a roller tappet in the bridge before the final installation of an associated tappet push rod.
Figure 2C:
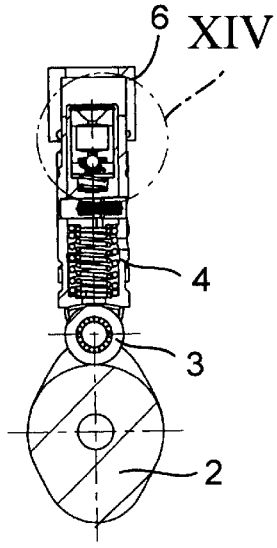
FIG. 2*c* is a sectional representation along line C—C of FIG. 1 showing a position of a roller tappet in the bridge after the final installation of an associated tappet push rod.
Figure 2D:
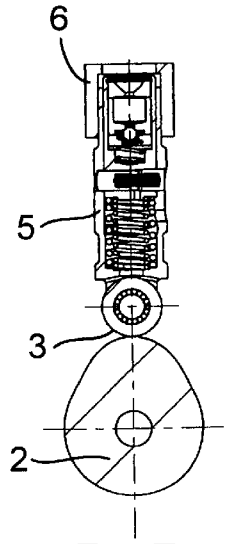
FIG. 2*d* is a sectional representation along line D—D of FIG. 1 showing a further position of a roller tappet in the bridge after the final installation of an associated tappet push rod.
Figure 13:
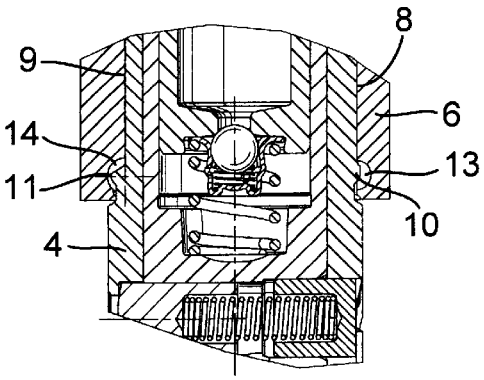
FIG. 13 is an enlarged representation of the encircled region XIII of FIG. 2*a* with the first roller tappet.
Figure 14:
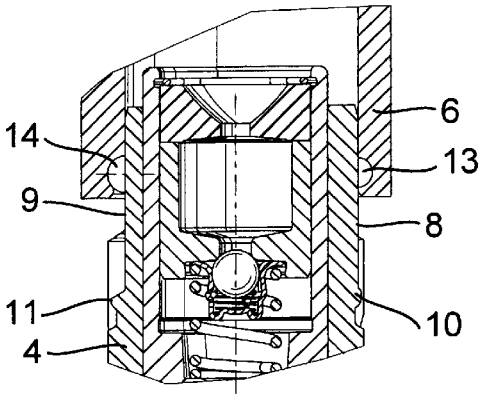
FIG. 14 is an enlarged representation of the encircled region XIV of FIG. 2*c* with the first roller tappet.
Figure 3:
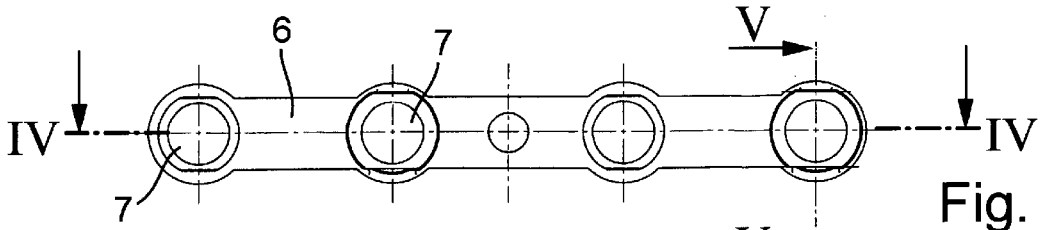
FIG. 3 is a bottom view of the anti-rotation bridge of FIG. 1.
Figure 4:
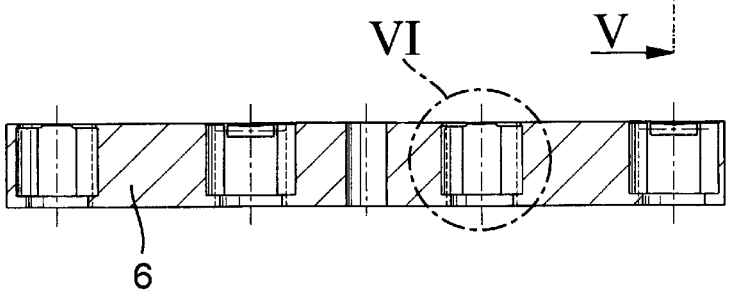
FIG. 4 is a section through the anti-rotation bridge taken along line IV—IV of FIG. 3.
Figure 5:
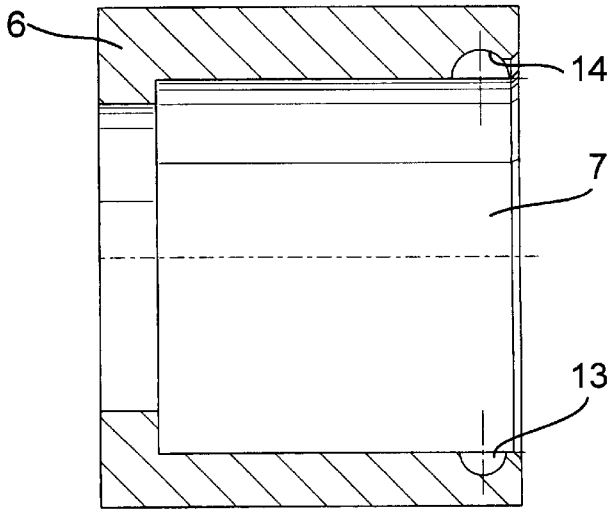
FIG. 5 is an enlarged representation of a section through the anti-rotation bridge taken along line V—V of FIG. 3.
Figure 6:
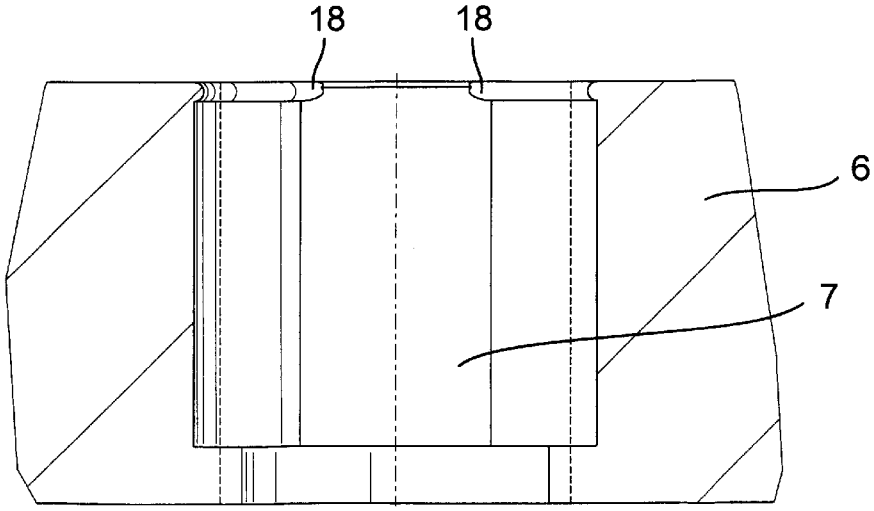
FIG. 6 is an enlarged representation of the encircled region VI of FIG. 4.

The valve train of the invention comprises a camshaft 1 having cams 2 for acting on tappet rollers 3 of roller tappets 4 and 5. At their ends opposite from the tappet rollers 3, the roller tappets are mounted for longitudinal displacement in a common anti-rotation bridge 6 by which they are also retained secure against rotation. The roller tappets are inserted into receptions 7 of the anti-rotation bridge 6 and bear with flat anti-rotation surfaces against flat surfaces of the bridge 6 that are formed within the receptions 7.

Figure 7:
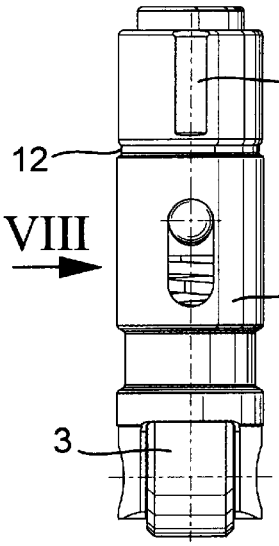
FIG. 7 is a side view of a first roller tappet of the invention.
Figure 8:
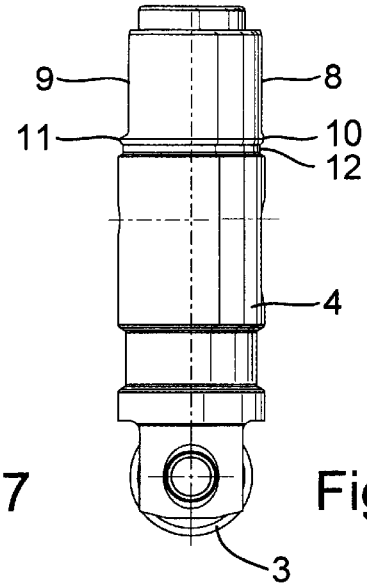
FIG. 8 shows the first roller tappet as seen in the direction of arrow VIII of FIG. 7.
Figure 9:
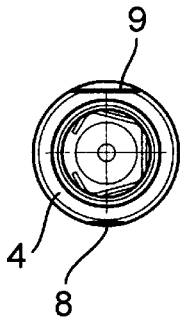
FIG. 9 is a top view of the first roller tappet.

In FIG. 1, two first roller tappets 4 and two second roller tappets 5 are retained in the bridge 6. As can be seen in FIGS. 7 and 9, a first roller tappet 4 comprises a smaller anti-rotation surface 8 and a larger anti-rotation surface 9. These surfaces are parallel to each other and are configured on the outer peripheral surface of the roller tappet 4. Due to these surfaces, a raised tappet contour 10 is formed beneath the smaller surface 8 and a raised tappet contour 11 is formed beneath the larger surface 9. A peripheral groove 12 of the roller tappet 4 is arranged adjacent these contours.

Within the reception 7, retention grooves 13 and 14 of the bridge 6 are situated at the lower ends of the anti-rotation surfaces 8 and 9 of the inserted roller tappet 4. The roller tappets 4 are mounted in the bridge 6 so that the raised contour 10 is situated in the retention groove 13 and the raised contour 11 is situated in the retention groove 14. The bridge 6 including the mounted tappets is fixed in the engine block of the internal combustion engine so that there is no contact in this position between the tappets and the cams 2 of the camshaft 1. When, following this, a tappet push rod 15 is installed for each roller tappet 4, the raised tappet contours 10 and 11 of the roller tappet 4 are pushed out of the retention grooves 13 and 14 of the bridge 6 till the roller tappet 4 comes into contact with its associated cam 2 on the camshaft 1. The anti-rotation surfaces 8 and 9 now act solely as an anti-rotation device and do not get clamped in the reception 7 of the bridge 6.

Figure 10:
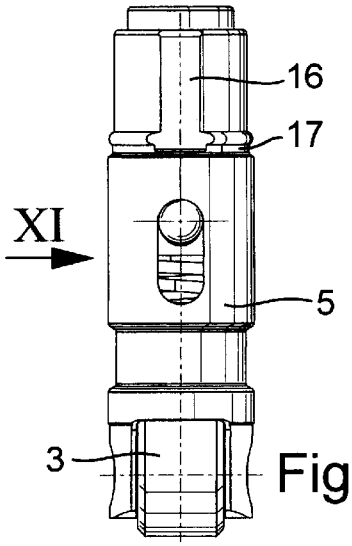
FIG. 10 is a side view of a second roller tappet of the invention.
Figure 11:
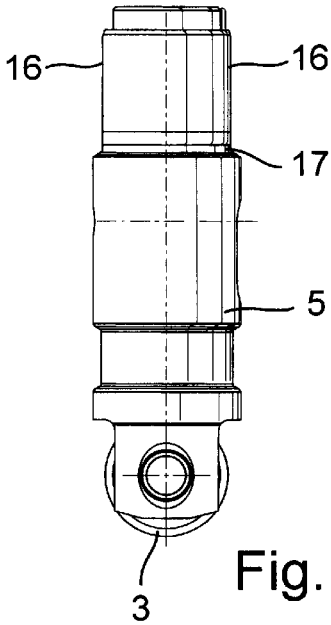
FIG. 11 shows the second roller tappet as seen in the direction of arrow XI of FIG. 10.
Figure 12:
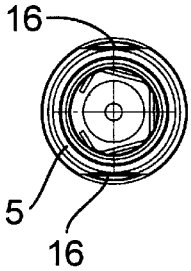
FIG. 12 is a top view of the second roller tappet.
Figure 15:
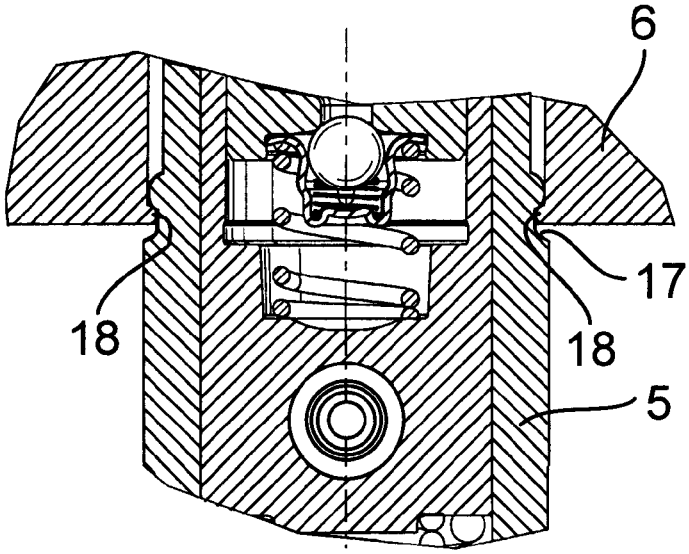
FIG. 15 is a representation corresponding to that of FIG. 13, with the second roller tappet.
Figure 16:
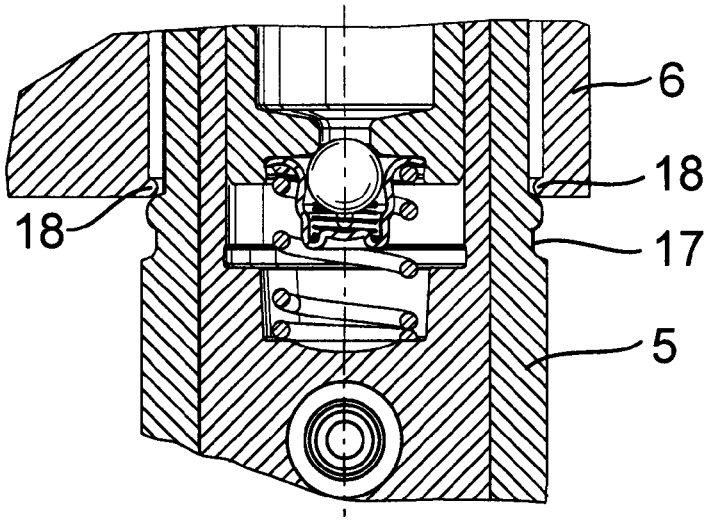
FIG. 16 is a representation corresponding to that of FIG. 14, with the second roller tappet.

The roller tappet 5 shown in FIGS. 10 to 12 comprises on the lower end of its two equally large anti-rotation surfaces 16, a tappet groove 17. A solid bead 18 is situated on one end of the associated reception 7 of the anti-rotation bridge 6. In the installed state of the roller tappet 5, this bead 18 projects into the tappet groove 17. When the bridge 6 has been fixed in the engine block of the internal combustion engine, there is still no contact between the roller tappet 5 and the associated cam 2 of the camshaft 1. Through the installation of the associated tappet push rod, the roller tappet 5 is moved over the solid bead 18 of the bridge 6 and thus comes into contact with the cam 2. In this case, too, the anti-rotation surfaces 16 now act only as an anti-rotation device and do not get clamped in the reception 7 of the bridge 6.

The invention therefore separates the clamping function during mounting from the anti-rotation function during engine operation.

What is claimed is:

1. A valve train of an internal combustion engine, said valve train comprising an elongate anti-rotation bridge comprising receptions spaced behind one another for receiving valve tappets configured as roller tappets, one of which tappets is arranged in each reception and is directed with a tappet roller toward a cam of a camshaft to extend at a right angel to a longitudinal axis of the camshaft while being slidably retained in the reception, said tappet being secured against rotation through anti-rotation surfaces which are configured on an outer peripheral surface of the tappet and bear against corresponding inner surfaces of the bridge within the reception, wherein the roller tappet comprises on an outer peripheral surface, raised tappet contours that are situated at the lower ends of the anti-rotation surfaces of the inserted roller tappet and engage into retention grooves of the bridge within the reception when the bridge including the mounted tappets is fixed in the internal combustion engine, and when, following this, a tappet push rod is installed for each roller tappet, the raised tappet contours of the roller tappet are pushed out of the retention grooves of the bridge.

2. A valve train of an internal combustion engine, said valve train comprising an elongate anti-rotation bridge comprising receptions spaced behind one another for receiving valve tappets configured as roller tappets, one of which tappets is arranged in each reception and is directed with a tappet roller toward a cam of a camshaft to extend at a right angle to a longitudinal axis of the camshaft while being slidably retained in the reception, said tappet being secured against rotation through anti-rotation surfaces which are configured on an outer peripheral surface of the tappet and bear against corresponding inner surfaces of the bridge within the reception, wherein the roller tappet comprises on the lower end of its anti-rotation surfaces a tappet groove, and a projecting solid bead is configured in each reception of the bridge and engages the tappet groove configured on the roller tappet in the installed state when the bridge is fixed in the internal combustion engine, and when, following this, an associated tappet push rod is installed, the roller tappet is moved over the solid bead of the bridge.

* * * * *